United States Patent [19]

Feldman

[11] 4,441,890

[45] Apr. 10, 1984

[54] METHOD FOR IMPROVING STABILITY OF RESIDUAL FUEL OILS

[75] Inventor: Nicholas Feldman, Woodbridge, N.J.

[73] Assignee: Exxon Research and Engineering Co., Florham Park, N.J.

[21] Appl. No.: 428,372

[22] Filed: Sep. 29, 1982

[51] Int. Cl.[3] ..... C10L 1/32

[52] U.S. Cl. ..... 44/51; 44/76

[58] Field of Search ..... 44/51, 76

[56] References Cited

U.S. PATENT DOCUMENTS

| | | | |
|---|---|---|---|
| 2,423,913 | 7/1947 | Vose | 44/51 |
| 2,548,630 | 4/1951 | Sorg et al. | 44/70 |
| 2,888,338 | 5/1959 | Fischl et al. | 44/63 |
| 2,923,611 | 2/1960 | Wieland | 52/5 |
| 2,958,590 | 11/1960 | Siegel | 44/62 |
| 4,182,613 | 1/1980 | Stover et al. | 44/51 |

FOREIGN PATENT DOCUMENTS

| | | |
|---|---|---|
| 605449 | 9/1960 | Canada . |
| 607389 | 10/1960 | Canada . |
| 1523597 | 9/1978 | United Kingdom . |

*Primary Examiner*—Charles F. Warren
*Assistant Examiner*—Margaret B. Medley
*Attorney, Agent, or Firm*—Eugene Zagarella, Jr.

[57] ABSTRACT

The method of inhibiting or reducing the level of asphaltic sediment formed in residual fuels by adding an alkylaryl sulfonic acid stabilizer to said fuel comprising the improvement of adding an effective stabilizing amount of said stabilizer to said fuel oil and maintaining said stabilized fuel at a selected high temperature of at least about 190° C. for a time sufficient to inhibit the formation or reduce the level of asphaltic sediment.

10 Claims, No Drawings

METHOD FOR IMPROVING STABILITY OF RESIDUAL FUEL OILS

BACKGROUND OF THE INVENTION

This invention relates to a method for improving the stability of residual fuel oils. More particularly, this invention relates to an improved economical method of inhibiting or reducing the level of asphaltic sediment separating from residual fuel oils by adding an effective stabilizing amount of an alkylaryl sulfonic acid stabilizer to the residual fuel oil and maintaining said stabilized fuel at a selected high temperature for a sufficient time to inhibit the formation or allow such reduction in sediment.

It is known that various types of instability may be exhibited by residual fuel oils. Among these are (1) separation of asphaltic or carbonaceous matter, sludge, dirt and water during storage at normal temperatures; (2) separation of black waxy material during storage at low temperatures; (3) increase in viscosity during storage at normal temperatures; and (4) incompatability or separation of insoluble matter on mixing of fuel oils from different sources.

Most present residual and intermediate fuel oils contain heavy asphaltic stocks in widely varying proportions. There is some evidence that certain constituents of these asphaltic stocks such as asphaltenes, carbenes and the like are colloidal in nature and thus blends containing such stocks would not be expected to form true solutions in all cases. Rather, some constituents would be dispersed in the blend and might separate under certain conditions of storage and use.

In the past, the precipitation of asphaltenes and resins from residual, i.e., residuum containing, fuels have been largely avoided by proper selection of blending components. Only distillate and residuum from the same or similar crudes were mixed so there was less likelihood of colloid destruction through changes in solvency. In addition, the severity of reduced crude processing was controlled to a level that produced distillate and residuum which, on reblending, provided compatible fuels. However, as crude availability tightened due to depletion of reserves and changes in political climate, and also as the need increased to process certain component fractions more severely to reduce sulfur levels, refining flexibility was lost. It became increasingly difficult to make components that would insure compatible blends, particularly those also meeting low sulfur specifications.

Additives of the detergent or dispersant type that are added to hydrocarbon fuels to control sludge separation are sometimes claimed to stabilize fuels against asphaltic constituent separation. However, most of them are either ineffective or only marginally effective at practical treating levels, especially for low sulfur intermediate fuels. Structurally, these additives are usually metal salts of alkylaryl sulfonic acids (see U.S. Pat. No. 2,888,338) or complex ashless dispersants containing amine, imide, ester or hydroxyl type polar functionality attached to an oil soluble hydrocarbon chain (see U.S. Pat. No. 2,958,590 and Canadian Pat. No. 605,449).

Oil soluble sulfonate additives have been taught to be useful for stabilization against oxidative deterioration (not sedimentation of asphaltic constituents) of middle distillate petroleum fuel oil compositions (see U.S. Pat. No. 2,923,611 and Canadian Pat. No. 607,389).

More recently in U.S. Pat. No. 4,182,613 the method of reducing the amount of asphaltic sediments in residual fuels through the use of alkylaryl sulfonic acids was disclosed. Generally while this technique is effective, it has been found that fairly high amounts of the sulfonic acid stabilizer and longer treatment times are needed to reduce the sediment to desired levels, making this method economically unattractive.

SUMMARY OF THE INVENTION

Now it has been unexpectedly discovered that a significant reduction in asphaltic sediment in residual fuel oils can be attained using a selected low level of alkylaryl sulfonic acid stabilizer when the treatment of residual fuel with stabilizer was made at a selected high temperature of at least 190° C.

More particularly, this invention is directed to the method of inhibiting or reducing the level of asphaltic sediment formed in residual fuel oils by adding an alkylaryl sulfonic acid stabilizer having from about 10 to about 70 carbon atoms to said fuel oil comprising the improvement of adding an effective stabilizing amount of said alkylaryl sulfonic acid stabilizer to said fuel oil and maintaining said stabilized fuel at a temperature of at least about 190° C. for a time sufficient to inhibit the formation or reduce the level of asphaltic sediment that forms or separates out.

DETAILED DESCRIPTION OF THE INVENTION

This invention relates to a method for improving the stability of residual fuel oil by adding an effective stabilizing amount of an alkylaryl sulfonic acid stabilizer to the fuel oil and maintaining the fuel at a selected temperature of at least about 190° C. for a time sufficient to inhibit the formation or allow a reduction in the level of asphaltic sediment that forms or separates out.

The main feature of this invention is the ability to significantly increase the effectiveness of the alkylaryl sulfonic acid stabilizer to inhibit the formation or reduce the level of asphaltene sediment that separates out or precipitates from fuel oil blends by using a selected high treatment temperature of at least about 190° C., preferably from about 190° to about 320° C. It is particularly noted that the use of the alkylaryl sulfonic acid stabilizer in accordance with this invention not only prevents sediment formation but also can resuspend sediment that has already formed in a fuel blend.

The alkylaryl sulfonic acids useful in the method of this invention as asphaltic sedimentation stabilizing additives generally have from about 10 to about 70 and preferably about 26 to about 46 carbon atoms. The alkyl substituent or substituents will preferably have about 18 to about 40 and more preferably 22 to 28 carbons.

The sulfonic acids suitable for this application can be prepared by several techniques. They may be entirely synthetic or prepared by sulfonation of natural petroleum derived alkyl aromatics. An example of the latter would be the sulfonic acids from the sulfuric acid, sulfur trioxide and the like treatment of petroleum fractions. Acids of this type which are particularly useful possess molecular weights within the range of 300 to 650, preferably about 450 550.

Suitable alkylaromatics for subsequent sulfonation can be synthesized by several techniques. For example, benzene, toluene, naphthalene or phenol can be alkylated with an olefinic fraction or a chlorinated paraffin using a Friedel-Crafts catalyst. The olefins in turn may be produced by oligomerization of ethylene, propylene, higher alpha-olefins or isobutylene using appropriate catalyst systems. Waxy paraffinic fractions can be chlorinated to a suitable level, e.g., one or more Cl atoms per molecule and subsequently reacted with an aromatic using $AlCl_3$ as the catalyst. Other methods can also be used. The technique should in no way limit this invention.

Sulfonation may be conducted using any one of several reagents under appropriate conditions. Oleum, concentrated $H_2SO_4$, $SO_3$, $SO_3$ complexes and $ClSO_3H$ are examples. Probably 20% oleum and $SO_3$ are the most popular reagents and $SO_3$ the best for this application.

With oleum, the reagent, in a 5–15 wt. % excess, would be added slowly to the alkylaromatics in a nonreactive hydrocarbon solvent with vigorous mixing and temperature control (about 25°–35° C.). The majority of the unreacted sulfuric acid and sludge would then be separated using gravity settling after dilution with water. A water or water alcohol wash is then used to remove the last traces of sulfuric acid.

The alkylaromatic can be sulfonated with $SO_3$ swept into the system with a dry carrier gas. Again a nonreactive solvent would be employed to reduce viscosity and facilitate mixing. Alternately, the alkylaromatic can be sulfonated with liquid $SO_3$ dissolved in liquid $SO_2$.

Other suitable techniques are well documented in the literature on organic synthesis (e.g., Kirk-Othmer, Encyclopedia of Chemical Technology, Second Edition, Vol. 19, pp. 291–301).

Thus, in summary a preferred class of sulfonic acids for use as additives according to this invention consists of monosulfonated alkylated mono- and/or bicyclic aromatic sulfonic acids which are formed by alkylating an aromatic nucleus and thereafter sulfonating the alkylated product. The alkyl group or groups of the alkylated mono- and bicyclic aromatic compounds average from 4 to 64, preferably from about 20 to about 40, total carbons and the group or groups may be straight chain and/or branched in structure. The preferred sulfonic acids for use in the invention are ones that are derived from sulfonation of mono-, di-, and trialkyl substituted benzene or naphthalene. Compounds that are especially preferred for sulfonation to the corresponding sulfonic acids are those having the structure

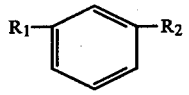

wherein $R_1$ is a hydrogen atom or an alkyl group that contains from 1–14 carbon atoms and $R_2$ is an alkyl group containing from about 14–36 carbon atoms. It will be noted that an alkylated naphthalene may be substituted for the alkylated benzene shown in the above structure. It is further preferred that the average number of carbon atoms among the alkyl groups of the alkylated mono- and bicyclic compounds illustrated above be about 20–40 and optimally about 22–28. Thus, specific examples of alkylated aromatic compounds of this type include tetradecyl benzene, dotriacosyl benzene, etc. An especially preferred alkylated monocyclic aryl sulfonic acid is the sulfonic acid of octacosyl benzene.

Especially preferred alkyl mono-aryl sulfonic acids are those acids that are formed by alkylating benzene with oligomers of propylene or $C_4$–$C_{10}$ 1-alkenes and thereafter sulfonating the resulting alkylate. The class of compounds may thus be identified as the polyalkyl benzene sulfonic acids. Insofar as the present invention is concerned, the compounds of this type that are of special interest are the compounds where the alkyl groups are derived from olefin polymers and contain from about 20 to about 40 carbon atoms each and especially about 22 to 28 carbon atoms and an especially preferred compound of this type used in the present invention is the octacosyl benzene sulfonic acid wherein the alkyl radical is derived from a nominal 28 carbon propylene oligomer.

The residual fuel oils, to which the present invention is applicable, are residua-containing oils such as straight residuum, vacuum distillate fuels such as flash distillate oils, vacuum bottoms, and various blends of such residua-containing oils with middle distillate, e.g., 150°–345° C. oils, particularly heavy gas oils, e.g., 260°–345° C. oils. Residua-containing oils are oils that contain residua from the distillation of crude oil or shale oil or mixtures thereof. They can also be residues obtained by thermal cracking or catalytic cracking processes. Generally, the residua, or residuum-containing fuel will contain about 5% to 100%, e.g., about 10 to 100% by weight of residuum, and will preferably have an initial boiling point above 315° C., most preferably about 345° C., at atmospheric pressure. If 100% residuum, the oil is generally designated as No. 6 fuel oil, Bunker C fuel oil, etc. Residual products usually have an extremely high viscosity and conventionally are blended with distillate oils to form lighter viscosity residuum containing fuels. The distillate oil can be a middle distillate fuel oil or a vacuum or flash-distillate oil. Vacuum fuel oils are frequently made by flash distillation and are then called flash distillatates. Flash distillates are therefore those distillate fuels obtained by flash distillation at reduced pressure of the residue obtained from the distillation of crude oil at atmospheric pressure.

These residual fuel oils which are usefully stabilized against asphaltic constituent agglomeration and resultant sediment formation are normally sold against specifications such as that described in the "Standard Specification for Fuel Oils", ASTM Designation: D 396-80, 1981 Annual Book of ASTM Standards, Part 23, page 221–226. In this particular specification, six grades are described: Numbers 1, 2, 4, 5, (light) 5 (heavy) and 6. The first two are "all-distillate" but the rest often contain residuum and could be subject to the problem of incompatability. The main basis for separation of the grades is viscosity with No. 4 having a minimum Saybolt viscosity of about 40 to 45 SSU at 38° C., No. 5 (light) has a minimum viscosity of about 125 SSU at 38° C., No. 5 (heavy) has a minimum viscosity of about 300 SSU at 38° C. and No. 6 (Bunker C) has a maximum viscosity of about 300 SSF at 50° C. Since Grades 4, 5 and 6 generally are residual fuels the Saybolt viscosity of fuels responsive to the additives of the invention ranges from about 40 SSU at 38° C. to about 300 SSF at 50° C. All grades are also subject to water, sediment and flash specifications.

Frequently a sulfur specification ranging from 0.3 to about 1.5 wt.% sulfur is placed on residual fuels, especially those being used in areas of high population density because of environmental considerations. For this reason, blends of middle distillates and residuum are utilized as intermediate fuels. If the components used to make an intermediate fuel are incompatible there is likely to be a ratio of residuum to distillate where the amount of sediment formed is at a maximum. This is illustrated in the following tabulation

| | wt. % Pitch (Residuum) in | | | | |
|---|---|---|---|---|---|
| | 3 | 5 | 10 | 15 | 20 |
| Blend with Middle Distillate Sediment by Hot Filtration (SHF) wt. % | 0.40 | 0.82 | 0.80 | 0.50 | |

As the concentration of pitch approaches zero, so does the amount of sediment filtered out of the blend in the SHF Test. In addition, as the pitch content increases above 20%, the sediment level generally again falls as the hydrocarbons in the heavier fraction solubilize the asphaltic constituents. However, it is frequently the blends with the greatest tendency to precipitate that are most in demand because of their limited sulfur contents.

It should not be construed from the above that low sulfur fuels, i.e., those containing from about 0.3 to about 1.5 wt.% sulfur, are the only ones that can benefit from treatment with this additive. Fuels of very different composition, if they are incompatible, benefit from use of the additive here described.

The Sediment by Hot Filtration (SHF) Test noted above and reported in "Industrial and Engineering Chemistry", Vol. 10, No. 12, pp. 678–680 (1938) is an analytical method developed to predict the tendency of a fuel oil to clog screens or nozzles of burners. Sediment in distillates and in residual fuels with viscosities not greater than 300 Saybolt Seconds Furol at 50° C. can be measured. A portion of the sample is placed in a jacketed filter and steam heated to about 95° C. and without dilution filtered through an asbestos pad, with suction of about 250 mm Hg. The sediment remaining on the pad after washing with a nonaromatic solvent such as high-boiling naphtha is reported at wt.% to the nearest 0.01% for residual fuels (fuels containing residuum).

The use of alkylaryl sulfonic acids in accordance with this invention may involve hydrocarbonaceous products resulting from a slurry catalytic hydroconversion process such as described in U.S. Pat. No. 4,134,825 or at the outlet of fixed bed hydroconversion processes, etc.

The method of this invention can be carried out by adding the oil soluble alkylaryl sulfonic acid stabilizer to an already heated residual fuel oil or the fuel oil can be heated subsequent to stabilizer addition. The required treatment temperature is at least about 190° C. and preferably from about 190° to about 320° C. The time of treatment must be long enough to inhibit the formation or allow for a reduction in the level of asphaltic sediment that forms or separates out. Generally this will be for a period of at least about 5 minutes or longer, more particularly for about 15 minutes to about 2 hours, and preferably from about 30 to about 60 minutes.

The amount of alkylaryl sulfonic acid stabilizer which is used in carrying out the method of this invention is significantly small, yet still effective in inhibiting the formation or reducing asphaltic sediment to an acceptable level and thus makes such method economically attractive. Generally this amount of stabilizer used will range from about 0.01 to about 2.0 wt.%, preferably from about 0.1 to about 1.0 wt.%, and more preferably from about 0.2 to about 0.8 wt.%, based on the total weight of the fuel composition.

The amount of alkylaryl sulfonic acid stabilizer and the time of treatment will vary as described above, but of course in each instance will depend on the amount of sediment that is involved.

The following examples are further illustrative of this invention and are not intended to be construed as limitations thereof.

EXAMPLE

A number of different residual fuel oil compositions obtained by thermal cracking of North Sea crudes were treated with different amounts of a $C_{24}$ alkylbenzene sulfonic acid stabilizer as described below, the resulting levels of sediment were measured using the SHF test described earlier. The results are shown in the following Table:

TABLE I

| | | | | Wt. % SHF | | | | | | | |
|---|---|---|---|---|---|---|---|---|---|---|---|
| | | | | | Wt. % Stabilizer Blended into Fuel at 90° C. | | | | Wt. % Stabilizer in Fuel for 60 Min. at 250–255° C. | | |
| Fuel | API Gravity at 60° F. | Kinematic Viscosity at 100° C. cSt | Wt. % Sulfur | No Stabilizer | 0.6 | 1.0 | 1.5 | 1.8 | 0.25 | 0.4 | 0.8 |
| A | 16.0 | 31.77 | 0.87 | 0.21 | 0.19 | 0.19 | 0.19 | — | 0.05 | — | — |
| B | 15.1 | 48.69 | 0.92 | 0.20 | 0.19 | 0.15 | 0.08 | — | 0.09 | 0.05 | — |
| C | 14.9 | 44.42 | 0.80 | 0.31 | 0.25 | 0.20 | — | 0.11 | — | 0.10 | 0.04 |
| D | 21.2 | 19.69 | 0.62 | 0.20 | 0.19 | 0.15 | 0.08 | — | — | 0.05 | — |

These results clearly illustrate the significant reduction in sediment level that is attained when using the high temperature treatment process of this invention and further shows the ability to effectively use smaller amounts of alkylaryl sulfonic acid stabilizer.

What is claimed is:

1. In the method of inhibiting or reducing the level of asphaltic sediment formed in residual fuel oils by adding an alkylaryl sulfonic acid stabilizer having from about 10 to about 70 carbon atoms to said fuel, the improvement comprising adding an effective stabilizing amount of said alkylaryl sulfonic acid stabilizer to said fuel oil and maintaining said stabilized fuel at a temperature of at least about 190° C. for a time sufficient to inhibit the formation or reduce the level of asphaltic sediment that forms or separates out.

2. The method of claim 1 wherein the amount of said stabilizer is from about 0.01 to about 2.0 wt.%, based on the total weight of the fuel composition.

3. The method of claim 2 wherein the treatment temperature is from about 190° to about 320° C.

4. The method of claim 3 wherein the treatment time is from about 15 minutes to about 2 hours.

5. The method of claim 3 wherein the amount of alkylaryl sulfonic acid stabilizer used is from about 0.1 to about 1.0 wt.%.

6. The method of claim 1 wherein said alkylaryl sulfonic acid has a total of about 26 to about 46 carbon atoms.

7. The method of claim 6 wherein said fuel oil has a Saybolt viscosity ranging from about 40 Saybolt Seconds Universal (SSU) at 38° C. to about 300 Saybolt Seconds Furol (SSF) at 50° C.

8. The method of claim 7 wherein said treatment temperature is from about 190° to about 320° C. and the amount of alkylaryl sulfonic acid stabilizer used is from about 0.01 to about 2.0 wt.%.

9. The method of claim 8 wherein from about 0.1 to about 1.0 wt.% of said stabilizer is used and the treatment time is from about 15 minutes to about 2 hours.

10. The method of claim 9 wherein from about 0.2 to about 0.8 wt.% of said stabilizer is used and the treatment time is from about 30 to about 60 minutes.

* * * * *